US007716895B2

(12) United States Patent
Fairorth et al.

(10) Patent No.: US 7,716,895 B2
(45) Date of Patent: May 18, 2010

(54) PORTABLE LIGHT EMITTING STAGE

(75) Inventors: James Fairorth, Lancaster, PA (US); Michael Tait, Lititz, PA (US); Adam Davis, Lancaster, PA (US)

(73) Assignee: TAIT Towers, Inc., Lititz, PA (US)

( * ) Notice: Subject to any disclaimer, the term of this patent is extended or adjusted under 35 U.S.C. 154(b) by 601 days.

(21) Appl. No.: 11/553,071

(22) Filed: Oct. 26, 2006

(65) Prior Publication Data

US 2008/0098660 A1 May 1, 2008

(51) Int. Cl.
*E04B 2/00* (2006.01)

(52) U.S. Cl. ..... 52/582.2; 52/6; 52/7; 52/578; 472/75

(58) Field of Classification Search ..... 52/6, 52/7, 578, 582.2; 472/61, 75, 81; 292/194, 292/195, 197, 202, 203, 210
See application file for complete search history.

(56) References Cited

U.S. PATENT DOCUMENTS

| | | | | | |
|---|---|---|---|---|---|
| 2,457,619 | A | | 12/1948 | Yocum | |
| 3,661,410 | A | * | 5/1972 | Larson et al. | 52/127.9 |
| 3,826,056 | A | * | 7/1974 | Smith et al. | 52/582.2 |
| 3,983,830 | A | * | 10/1976 | Morgan | 114/77 R |
| 4,150,630 | A | * | 4/1979 | Pokorny et al. | 108/64 |
| 4,303,969 | A | * | 12/1981 | Hamilton et al. | 362/153 |
| 4,329,739 | A | * | 5/1982 | Loebner | 362/153 |
| 4,340,929 | A | | 7/1982 | Konikoff et al. | |
| 4,631,647 | A | | 12/1986 | Ranney | |
| 4,635,425 | A | | 1/1987 | Cova | |
| 4,638,604 | A | * | 1/1987 | Rogers et al. | 52/6 |
| 4,907,361 | A | | 3/1990 | Villard | |
| 4,915,034 | A | * | 4/1990 | Grabe et al. | 108/65 |
| 5,060,432 | A | | 10/1991 | Christian | |
| 5,117,596 | A | | 6/1992 | Leslie et al. | |
| 5,323,564 | A | * | 6/1994 | Mensching et al. | 52/7 |
| 5,452,925 | A | * | 9/1995 | Huang | 292/57 |
| 5,471,804 | A | * | 12/1995 | Winter, IV | 52/220.1 |
| 5,493,825 | A | | 2/1996 | Gaston | |
| 5,589,654 | A | | 12/1996 | Konwiser et al. | |
| 5,634,309 | A | * | 6/1997 | Polen | 52/392 |
| 5,820,170 | A | * | 10/1998 | Clancy | 292/26 |
| 6,082,886 | A | | 7/2000 | Stanford | |
| 6,152,498 | A | * | 11/2000 | Lindqvist | 292/53 |
| 6,188,933 | B1 | * | 2/2001 | Hewlett et al. | 700/19 |
| 6,293,052 | B1 | | 9/2001 | Varnado, Jr. | |
| 6,732,478 | B1 | * | 5/2004 | Russell et al. | 52/28 |
| 6,910,357 | B2 | * | 6/2005 | Hirvi | 70/422 |
| 2004/0018122 | A1 | * | 1/2004 | Micklash et al. | 422/130 |

* cited by examiner

*Primary Examiner*—David Dunn
*Assistant Examiner*—Joshua Ihezie
(74) *Attorney, Agent, or Firm*—McNees Wallace & Nurick, LLC

(57) ABSTRACT

A portable light emitting stage component and portable stage system. The stage components having a deck supported by a support portion. The support portion includes at least one light producing element arranged and disposed to direct light through the deck. The support portion further includes at least one connector having at least one of a latch member and a receiving member. The latch member has features that clampingly secure stage components together when engaged with features of a receiving member to form a substantially planar surface made up of a plurality of decks.

20 Claims, 6 Drawing Sheets

PORTABLE LIGHT EMITTING STAGE

FIELD OF THE INVENTION

The present invention is directed to portable lighted structures. In particular, the present invention is directed to stage platforms and structures having lighting integrated therein.

BACKGROUND OF THE INVENTION

Known staging systems typically include complicated and/or large individual components and require assembly of the components with threaded bolts or screws. Portable structures, such as stages or platforms, must be capable of breaking down into relatively small units that can be loaded onto trucks or airplanes for transport. Use of conventional connections, such as threaded bolts or screws increases the complexity of assembly and disassembly, further increasing the time and labor required for the assembly and disassembly. In addition, the portable structures must be capable of assembly in a short amount of time, by personnel having little or no technical skill. The above benefits must be provided while providing a platform that is capable of supporting a large amount of weight, such as the weight of theatrical performers and their associated equipment.

Stages incorporating lighting or video elements have found increasing use in theatrical performances. Portable stages that incorporate lighting or video have additional components that require intensive labor and/or time to erect and/or disassemble. In addition, the increased weight from the components and the complexity of the installation of additional lighting components into support components create additional burdens for maintaining support of the structure and makes assembly and disassembly of the stage more difficult.

What is needed is a portable platform structure incorporating lighting and/or video elements that is easily assembled and disassembled with little or no technical skill, having a stable structure, where the structure does not suffer from the drawbacks of the prior art.

SUMMARY OF THE INVENTION

One aspect of the present invention includes a portable light emitting stage component and portable stage system. The stage components include a deck supported by a support portion. The support portion includes at least one light producing element arranged and disposed to direct light through the deck. The support portion further includes at least one connector having at least one of a latch member and a receiving member. The latch member has features that clampingly secure stage components together when engaged with features of a receiving member to form a substantially planar surface made up of a plurality of decks.

Another aspect of the invention includes a method for erecting a portable light emitting stage. The method includes positioning a first stage component adjacent a second stage component. Each stage component has a deck supported by a support portion. The support portion also has at least one light producing element arranged and disposed to direct light through the deck. The stage component also has at least one connector arranged and disposed to releasably connect adjacent support portions to form a substantially planar surface area made up of a plurality of deck. The method includes engaging the connector of the first stage component with the connector of the second stage component to clampingly secure the stage components together.

An advantage of the present invention is that stages incorporating lighting or video may be easily assembled and disassembled with little or no technical skill.

Another advantage of the present invention is that the stages incorporating lighting or video may be disassembled into small components which may be fitted into cargo spaces of tractor-trailers or aircraft.

Still another advantage of the present invention that the connections between stage components incorporating lighting or video do not require the use of threaded bolts or screws.

Still, another advantage of the present invention that the stage incorporating lighting or video may be assembled by hand with little or no assistance of tools.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
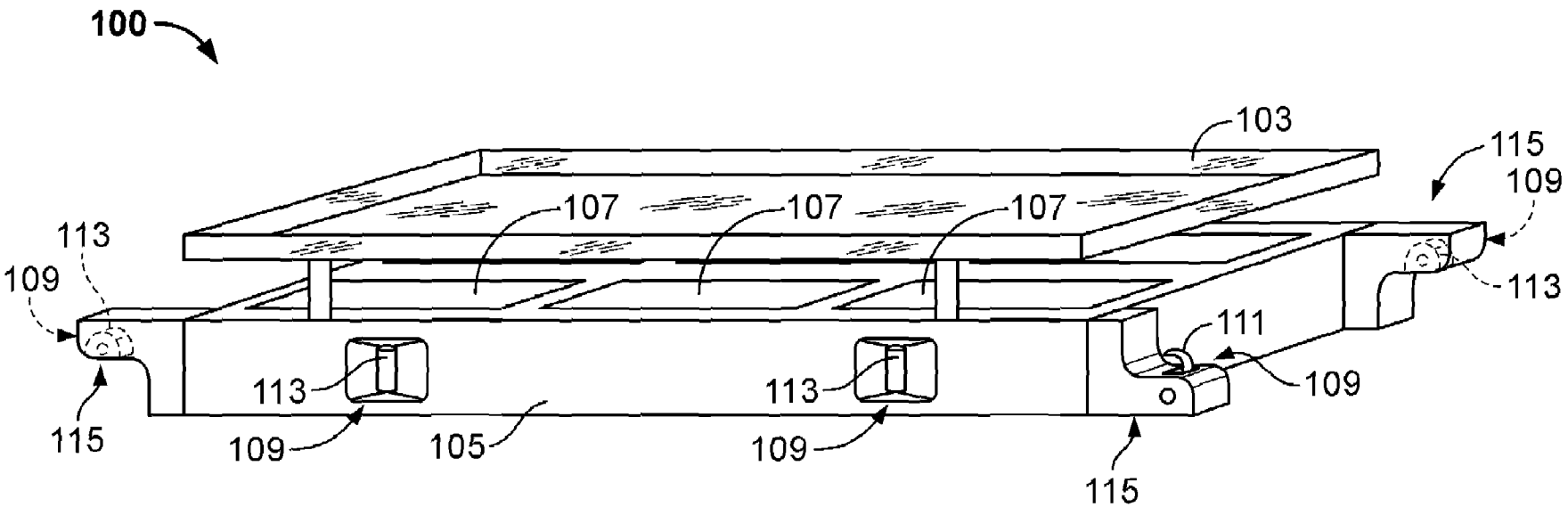
FIG. 1 shows an elevational perspective view of a stage component according to an embodiment of the present invention.

FIG. 1 shows a portable light emitting stage component 100 according to an embodiment of the present invention. Stage component 100 includes a deck 103 supported by a support portion 105. Deck 103 is preferably a rigid transparent material capable of supporting the weight of performers and/or equipment related to a theatrical performance. Suitable materials for fabricating the deck 103 include, but are not limited to, plexiglass, glass, polymeric and other substantially rigid transparent or semi-transparent material. Although FIG. 1 shows the support portion 105 and the deck 103 as having a substantially rectangular geometry, the present invention is not limited to a rectangular geometry and may include any geometry that may be formed into a stage. Further, the deck 103 may be substantially planar or have features such as bulges, slopes or textures, as desired to produce the desired visual effect for the stage. The support portion 105 includes light producing elements 107. Light producing elements 107 preferably include light sources capable of emitting sequenced lights. Sequenced lights include a plurality of light sources that are controlled to display varying intensity and/or color of light. In a preferred embodiment, the sequenced lights include light emitting diodes (LEDs) controlled to provide images, including moving images. A plurality of light producing elements 107 may be positioned adjacent to each other to increase the surface area onto which images are displayed (see, for example, FIG. 5). The light producing elements 107 are preferably in communication with each other and controlled by a single or a series of controllers, which coordinate the display provided. The light producing elements 107 may be connected to each other and/or the controller by any suitable means, including, but not limited to, wired or wireless connections. While not so limited, the deck 103 is preferably maintained at a position above the light producing elements 107 that provides a gap sufficient to provide cooling for the light producing portion and to provide an aesthetically pleasing view of the display provided by the light producing elements 107. Stage component 100 includes connectors 109 for connecting the stage component 100 to adjacent stage components 100. In the embodiment shown in FIG. 1, the connectors 109 have mating components, wherein connector 109 may include either a latch member 111 or a receiving member 113. The latch member 111 includes a feature that engages with receiving member 113 in order to clamp together and retain the adjacent stage components 100 in position, to form a substantially planar surface comprising a plurality of decks 103, while providing sufficient support at the junction between stage components 100 to carry loads that include theatrical performers and/or the equipment related to a theatrical performance. The features of the latch member 111 and/or receiving member 113 may include any geometry that provides clamping sufficient to provide a connection that retains adjacent stage components 100. As shown in FIG. 1, the features of the latching member 111 include a semi circular hook shaped member. The features of the receiving member 113 shown in FIG. 1 include a cylindrical post arranged in an opening, which is configured to receive the hook shaped member feature of the latching member 111.

In addition to connectors 109, the stage component 100 of FIG. 1 includes protrusions 115 at ends of the support portion 105 of stage component 100 that, in conjunction with connectors 109, engage adjacent protrusions and provide additional support. The protrusions 115 are configured to engage mating protrusions 115 to substantially retard relative movement between adjacent stage components 100 and to provide additional support for the interface between adjacent stage components 100. In one embodiment of the invention the protrusions 115 may be configured without connectors 109 and may be disattachably engaged so as to provide sufficient support to the connection between adjacent stage components 100 to support the weight of performers and/or the equipment related to a theatrical performance.

Figure 2:
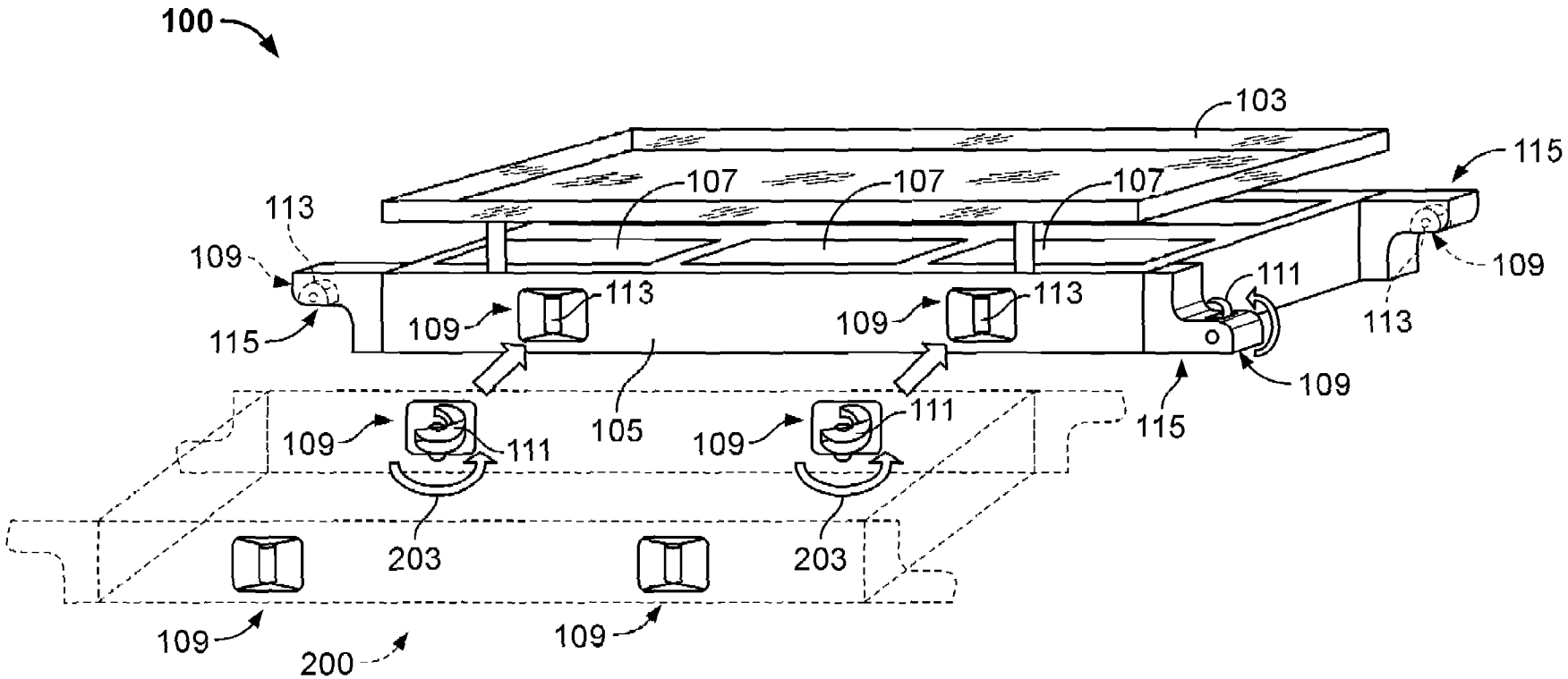
FIG. 2 shows the connections between stage components according to an embodiment of the present invention.

FIG. 2 shows stage component 100 of FIG. 1, wherein an adjacent stage component 200 (shown in broken lines) having connectors 109 (shown in solid lines to illustrate relative positioning) are positioned with respect to connectors 109 of stage component 100. Latch members 111 are rotatable in direction 203, wherein the rotation facilitates engagement of the features of latch member 111 with features of receiving member 113. While FIGS. 1 and 2 show latch member 111 as being rotatable and receiving member 113 as being substantially static, either or both of the latch member 111 and receiving member 113 may be movable to provide the desired engagement between the latch member 111 and the receiving member 113.

Figure 3:
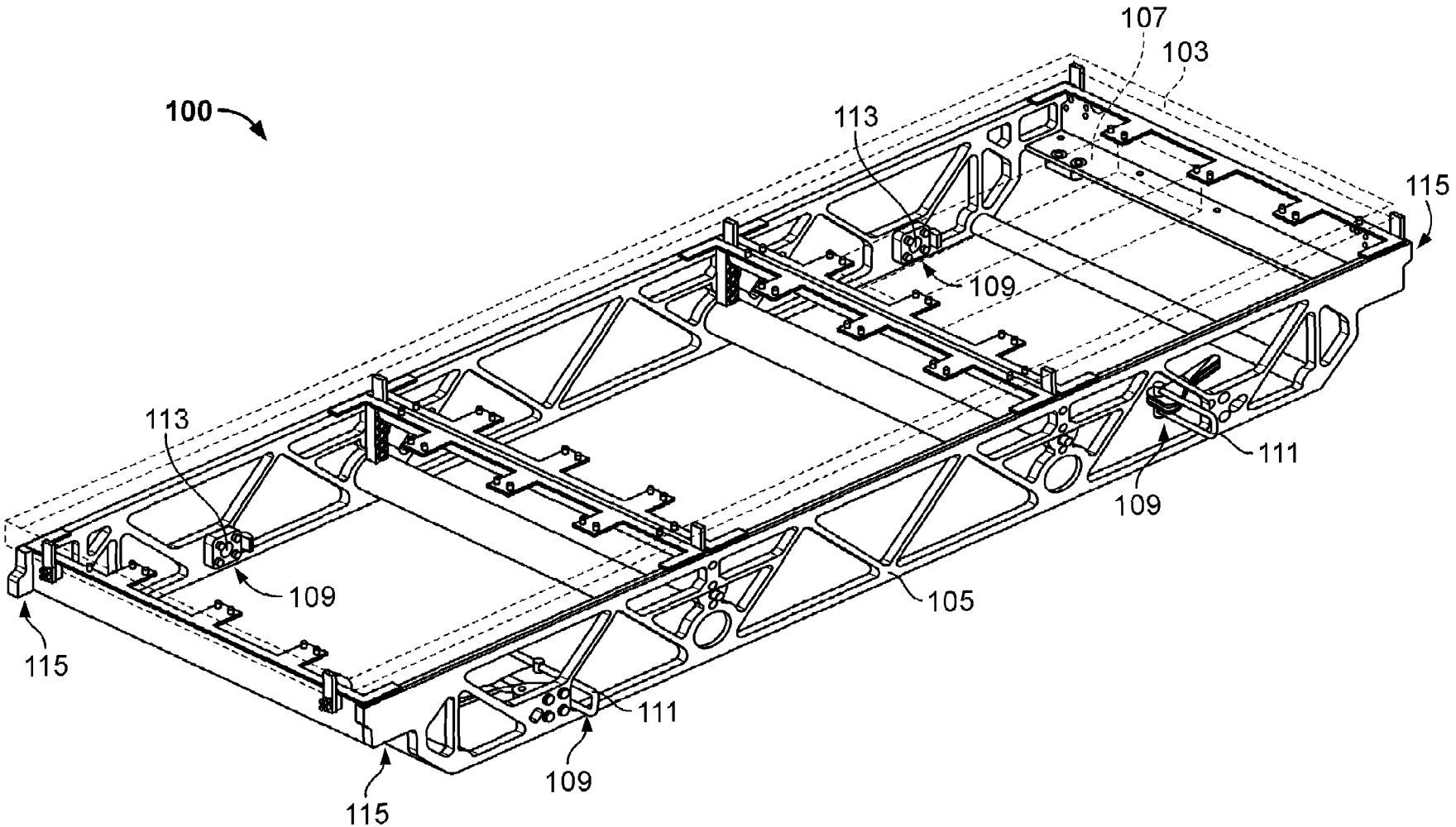
FIG. 3 shows a cutaway view of a stage component according to another embodiment of the present invention.

FIG. 3 shows a stage component 100 according to an alternate embodiment of the present invention. As in the stage component 100 shown in FIG. 1, the stage component 100 shown in FIG. 3 includes a deck 103 supported by a support portion 105. The support portion 105 includes light producing elements 107. Light producing elements 107 preferably include light sources capable of emitting sequenced lights. A plurality of light producing elements 107 may be positioned adjacent to each other to increase the surface area onto which images are displayed (see, for example, FIG. 5). Stage component 100 includes connectors 109 for connecting the stage component 100 to adjacent stage components 100. FIG. 3 includes the deck 103 and the light producing elements 107 in broken lines in order to better illustrate the arrangement of connectors 109 and support portion 105. The arrangement of support portion 105 and deck 103 shown in FIG. 3 has the advantage that the arrangement provides a large continuous surface area of deck 103 that allows transmission of light from light producing elements 107. The assembly of a plurality of stage components 100, as shown in FIG. 3, permits the formation of a large substantially continuous surface on which theatrical performers and/or equipment related to a theatrical performance may be supported.

As shown in FIG. 3, the features of the latching member 111 on support member 105 in this embodiment includes a U-shaped loop member. The features of the receiving member 113 shown in FIG. 3 includes a hook shaped member, which is configured to receive the U-shaped loop member feature of the latching member 111. Protrusions 115 shown in FIG. 3 are configured to engage adjacent stage components 100 and provide vertical support by engaging protrusions present on the adjacent stage component 100. Although not shown in FIG. 3, the protrusions 115 may further include connectors 109 or other devices suitable for connecting or retaining the stage components 100. The present invention is not limited to a single light producing element 107, nor the particular arrangement of deck 103 shown in FIG. 3.

Figure 4:
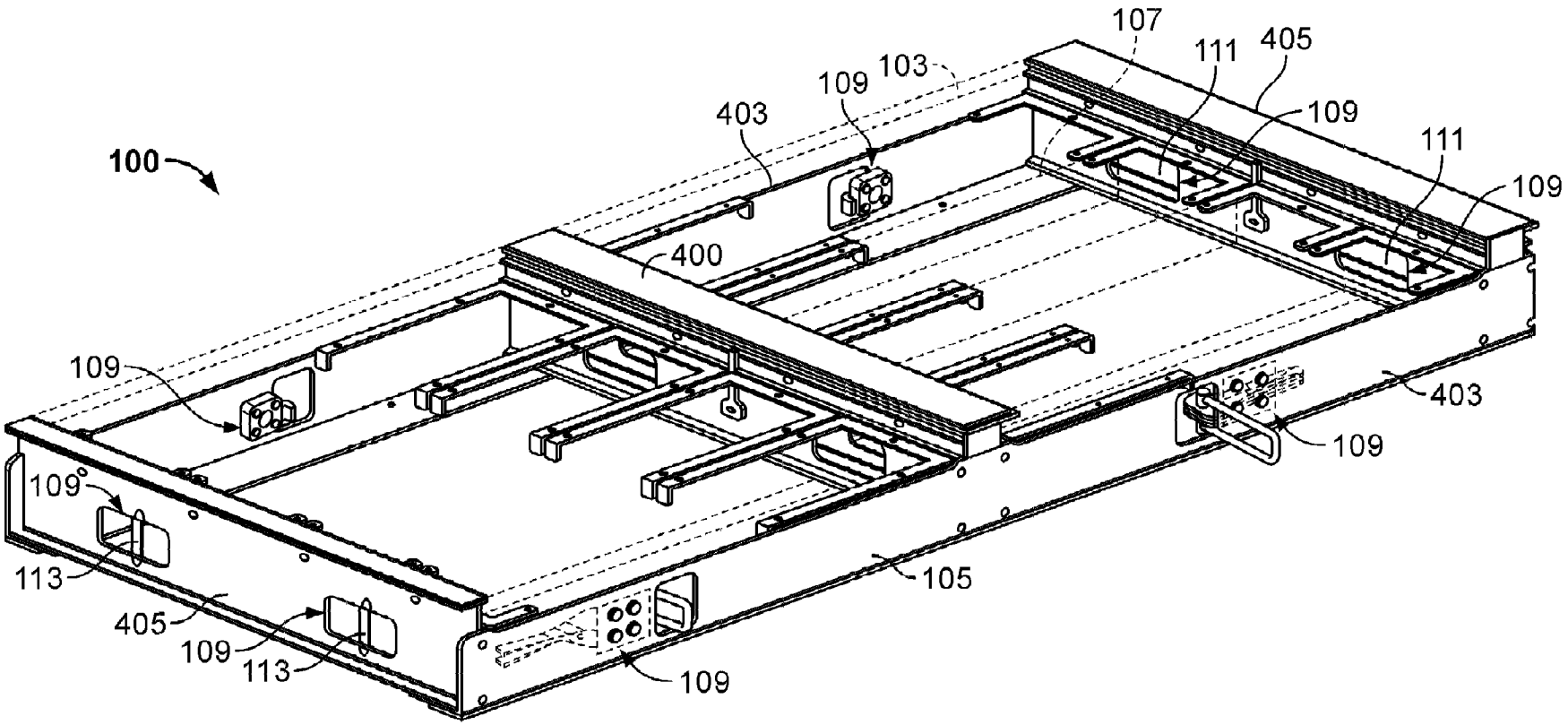
FIG. 4 shows a cutaway view of a stage component according to still another embodiment of the present invention.

FIG. 4 shows an alternate embodiment of the present invention. As in the stage component 100 shown in FIGS. 1 and 3, the stage component 100 shown in FIG. 4 includes a deck 103 supported by a support portion 105. However, FIG. 4 includes an alternate arrangement of deck 103 and support portion 105. This embodiment includes the advantage of increased support across the surface of the deck 103, while providing significant surface area across the deck through which the light producing elements 107 may direct light. In addition, surface 400, which extends above the deck may further include light producing elements 107 or other lighting devices to further provide desirable lighting on the stage component. A plurality of light producing elements 107 may be positioned adjacent to each other to increase the surface area onto which images are displayed (see, for example, FIG. 5). The support portion 105 includes a side surface 403 and an end surface 405. Stage component 100 includes a first set of connectors 109 for connecting the stage component 100 to adjacent stage components 100 along side surface 403 of the support portion 105 for connecting adjacent stage components 100 in a side-by-side arrangement. In addition, the stage component 100 includes a second set of connectors 109 on end surface 405 for connecting adjacent stage component 100 in an end-to-end arrangement. FIG. 4 includes the deck 103 and the light producing elements 107 in broken lines in order to better illustrate the arrangement of connectors 109 and support portion 105 and is not limited to a single light producing element 107, nor the particular arrangement of deck 103 shown.

As shown in FIG. 4, the first set of connectors 109 on the side surface 403 includes latching member 111 having features including a U-shaped loop member. The first set of connectors on the side surface 403 also includes a receiving member 113 having a hook shaped member, which is configured to receive the U-shaped loop member feature of the latching member 111. The second set of connectors on the end surface 405 includes latching member 111 having features including a semi circular hook shaped member. The second set of connectors on the side surface 403 also includes a receiving member 113 having a cylindrical rod shaped member, which is configured to receive the semi-circular hook shaped member feature of latching member 111. Any combination of types and placement of connectors 109 may be utilized that provides a clamping engagement and supports adjacent stage components 100.

Figure 5:
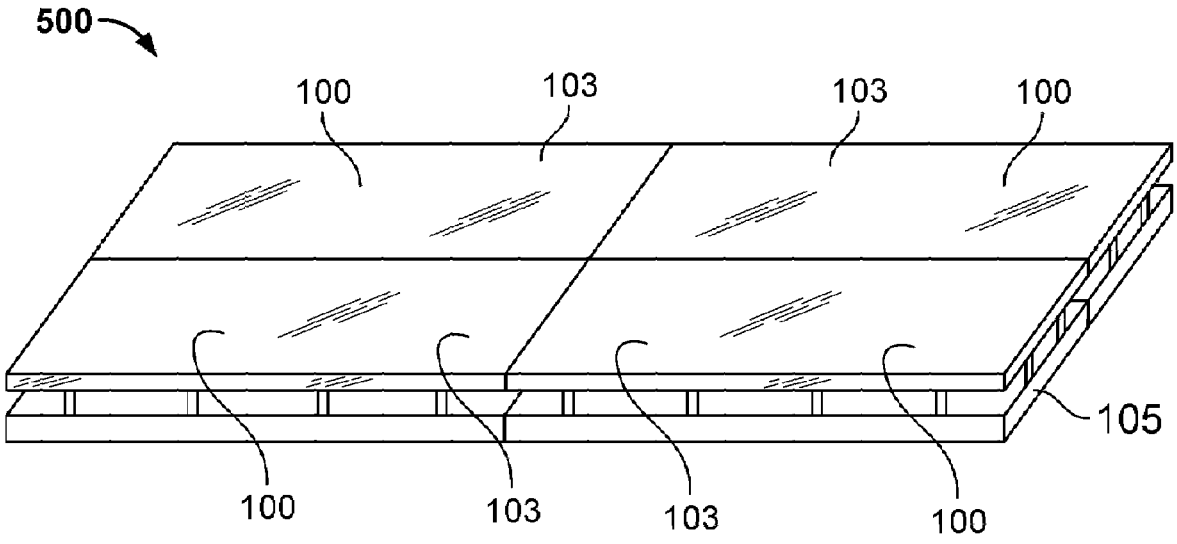
FIG. 5 shows an elevation perspective view of a stage assembly according to an embodiment of the present invention.

FIG. 5 shows a stage assembly 500 made up of a plurality of stage components 100 assembled to provide a substantially continuous surface area made up of decks 103. Any number of stage components 100 may be utilized in forming stage assembly 500. In addition, the geometry of stage components 100 may be any geometry that may be fastened together with connectors 109 to form a stage assembly 500. The stage assembly 500 may be self-supporting or may have spatially located placed support members (not shown in FIG. 5). In another embodiment of the present invention, the stage assembly 500 may be fastened to a frame (not shown in FIG. 5) that is configured to permit actuation of the stage assembly 500. In this embodiment of the invention, the stage assembly may be lifted, inverted, rotated, or actuated with any other combination of movements that provide a visually desirable stage display.

Figure 6:
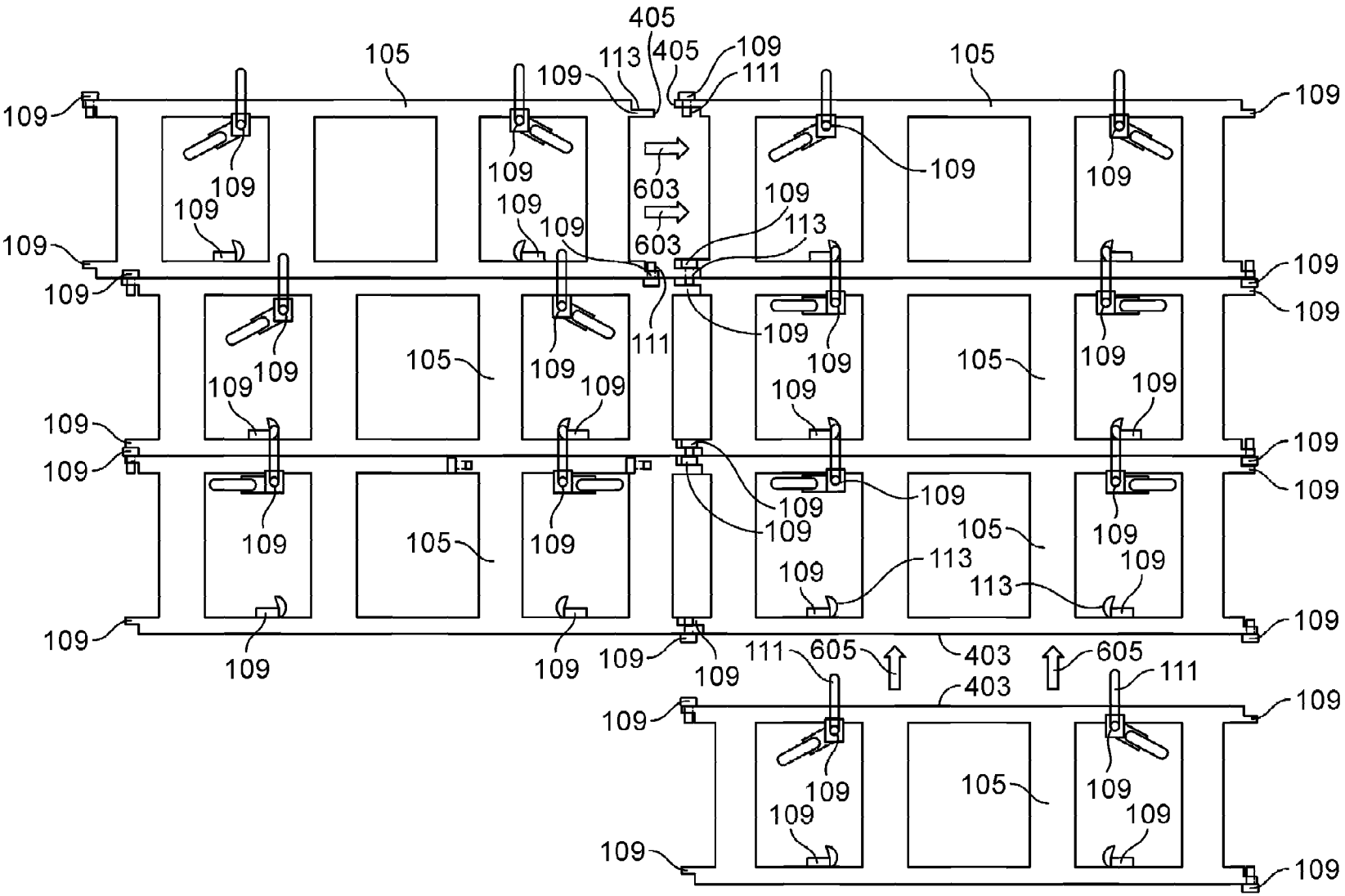
FIG. 6 shows a cutaway view of a stage assembly according to an embodiment of the present invention.

FIG. 6 is a cutaway view of a stage assembly 500, wherein a plurality of stage components 100 are positioned adjacent to one another and connectors 109 are engaged with one another. In the end-to-end connection arrangement, stage components 100 are positioned in direction 603 with end surfaces 405 adjacent one another. Connectors 109 are placed in latching engagement to retain the stage components 100 in place adjacent to one another. In the embodiment shown in FIG. 6, connectors 109 disposed at end surfaces 405 include latching member 111 having a pull pin connector feature that engages a mating receiving member 113 having an opening (not shown) to form the latching engagement. In the side-to-side connection, stage components 100 are positioned in direction 605 with side surfaces 403 adjacent one another. Connectors 109 are placed in latching engagement to retain the stage components 100 in place adjacent to one another. In the embodiment shown in FIG. 6, connectors 109 disposed at side surfaces 403 are latching member 111 having a U-shaped loop member feature configured to engage a mating receiving member 113 having a hook member feature. The assembly of the stage can be repeated to create the desired stage size. Components of varying sizes and geometries may be connected together in the arrangement shown to provide a visually pleasing display.

The connectors 109 of the present invention may include a connector mechanism, such as draw latches, pull pin connectors, coffin locks, and any other quickly disconnected system that is capable of connecting the component units together with a quickly disconnectable clamping engagement with sufficient support to function as a decking or wall system.

In addition to the embodiments shown and described above, the decking portion 103 and the support portion 105 may also have geometries, attached devices or features that interlock separate stage components 100 to provide additional support and ease of positioning during assembly. The component units are preferably sized for easy disassembly and transport. In a preferred embodiment, the component units are configured to a size that fits within the cargo hold of a 747, or similar aircraft. In addition, the stage components 100 are arranged and/or discreetly labeled in order to provide quick assembly, while providing suitable support and providing the desired display for the decks 103.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A portable light-emitting stage component of a stage assembly, the stage component comprising:

a deck supported by a support portion, the support portion comprising:

at least one light-producing element arranged and disposed to direct light through the deck;

a first side comprising a first rotatable latch member, the first side and the axis of rotation of the first rotatable latch member being substantially coplanar or substantially parallel, the first rotatable latch member comprising a first hook;

a second side comprising a first receiving member, the first receiving member comprising a first post;

a first end comprising a first protrusion; and a second end comprising a second protrusion; and wherein at least a portion of the deck is composed of a substantially transparent material; and wherein the first rotatable latch member is configured to engage a receiving member of a first corresponding stage component having a deck, the first receiving member is configured to engage a rotatable latch member of a second corresponding stage component having a deck, the first protrusion is configured to engage a protrusion of a third corresponding stage component having a deck, and the second protrusion is configured to engage a protrusion of a fourth corresponding stage component having a deck.

2. The stage component of claim 1, the first protrusion comprising a second rotatable latch member, the second rotatable latch member comprising a second hook.

3. The stage component of claim 2, the second protrusion comprising a second receiving member, the second receiving member comprising a second post.

4. The stage component of claim 2, wherein the first end and the axis of rotation of the second rotatable latch member are substantially parallel.

5. The stage component of claim 4, wherein the deck and the axis of rotation of the second rotatable latch member are substantially parallel.

6. The stage component of claim 1, the second protrusion comprising a second receiving member, the second receiving member comprising a second post.

7. The stage component of claim 6, wherein the second end and the second post are substantially parallel.

8. The stage component of claim 7, wherein the deck and the second post are substantially parallel.

9. The stage component of claim 1, wherein the first side, the second side, the first end, and the second end form a rectangular geometry.

10. The stage component of claim 9, wherein the first side and the second side are substantially parallel.

11. The stage component of claim 1, wherein the deck and the axis of rotation of the first rotatable latch member are substantially perpendicular.

12. The stage component of claim 1, wherein the first hook is semicircular.

13. The stage component of claim 1, wherein the second side and the first post are substantially coplanar or substantially parallel.

14. The stage component of claim 13, wherein the deck and the first post are substantially perpendicular.

15. A portable light-emitting stage system comprising a plurality of stage components, at least one of which comprises:

a deck supported by a support portion, the support portion comprising:

at least one light-producing element arranged and disposed to direct light through the deck;

a first side comprising a first rotatable latch member, the first side and the axis of rotation of the first rotatable latch member being substantially coplanar or substantially parallel, the first rotatable latch member comprising a first hook;

a second side comprising a first receiving member, the first receiving member comprising a first post;

a first end comprising a first protrusion; and a second end comprising a second protrusion; and wherein at least a portion of the deck is composed of a substantially transparent material; and wherein the first rotatable latch member is configured to engage a receiving member of a first corresponding stage component having a deck, the first receiving member is configured to engage a rotatable latch member of a second corresponding stage component having a deck, the first protrusion is configured to engage a protrusion of a third corresponding stage component having a deck, and the second protrusion is configured to engage a protrusion of a fourth corresponding stage component having a deck.

16. The stage system of claim 15, wherein the deck and the axis of rotation of the first rotatable latch member are substantially perpendicular.

17. The stage system of claim 16, the first protrusion comprising a second rotatable latch member, the second rotatable latch member comprising a second hook, and the second protrusion comprising a second receiving member, the second receiving member comprising a second post.

18. The stage system of claim 17, wherein the second side and the first post are substantially coplanar or substantially parallel, and wherein the deck and the first post are substantially perpendicular.

19. The stage system of claim 18, wherein the first end and the axis of rotation of the second rotatable latch member are substantially parallel, wherein the deck and the axis of rotation of the second rotatable latch member are substantially parallel, wherein the second end and the second post are substantially parallel, and wherein the deck and the second post are substantially parallel.

20. The stage system of claim 19, wherein the first side, the second side, the first end, and the second end form a rectangular geometry, and wherein the first side and the second side are substantially parallel.

* * * * *